US005423529A

United States Patent [19]

Saito et al.

[11] Patent Number: 5,423,529

[45] Date of Patent: Jun. 13, 1995

[54] PAPER FEEDER FOR PORTABLE PRINTER

[75] Inventors: Yukio Saito; Takumi Kawamura; Masaki Okuyama; Tsutomu Munekata, all of Inagi, Japan

[73] Assignee: Fujitsu Isotec Limited, Tokyo, Japan

[21] Appl. No.: 323,055

[22] Filed: Oct. 14, 1994

Related U.S. Application Data

[63] Continuation of Ser. No. 79,455, Jun. 21, 1993, abandoned, which is a continuation of Ser. No. 827,630, Jan. 29, 1992, abandoned.

[30] Foreign Application Priority Data

Jan. 29, 1991 [JP] Japan ..... 3-008908

[51] Int. Cl.[6] ..... B65H 1/08

[52] U.S. Cl. ..... 271/127; 271/145; 400/629; 400/691; 211/DIG. 1

[58] Field of Search ..... 271/3, 157, 162, 164, 271/145, 127, 126; 400/624, 625, 629, 680, 691, 692, 693; 403/DIG. 1; 292/251.5; 248/206.5; 211/DIG. 1

[56] References Cited

U.S. PATENT DOCUMENTS

| | | | |
|---|---|---|---|
| 1,236,234 | 8/1917 | Troje | 403/DIG. 1 X |
| 2,615,738 | 10/1952 | Johnson | 403/DIG. 1 X |
| 3,043,289 | 7/1962 | Fox | 292/251.5 X |
| 4,484,682 | 11/1984 | Crow | 248/206.5 X |
| 4,494,659 | 1/1985 | Spees | 211/DIG. 1 X |
| 4,688,957 | 8/1987 | Prevignano | 400/605 |
| 4,722,623 | 2/1988 | Kikuchi et al. | 400/624 X |
| 4,904,100 | 2/1990 | Enix | 400/613 |
| 4,968,016 | 11/1990 | Koyama | 271/162 X |
| 5,028,934 | 7/1991 | Kasai et al. | 347/76 PH |
| 5,138,373 | 8/1992 | Hoyer | 271/162 X |
| 5,236,265 | 8/1993 | Saito et al. | 400/680 X |

FOREIGN PATENT DOCUMENTS

| | | | |
|---|---|---|---|
| 0208203 | 1/1987 | European Pat. Off. . | |
| 0310060 | 4/1989 | European Pat. Off. . | |
| 196379 | 10/1985 | Japan | 400/624 |
| 13370 | 1/1987 | Japan | 400/625 |
| 46823 | 2/1987 | Japan | 271/157 |
| 136437 | 6/1987 | Japan | 400/691 |
| 192639 | 8/1989 | Japan | 271/157 |
| 102025 | 4/1991 | Japan | 271/162 |

*Primary Examiner*—James R. Bidwell
*Assistant Examiner*—Boris Milef
*Attorney, Agent, or Firm*—Staas & Halsey

[57] ABSTRACT

A paper feeder is arranged so that a hand-carry type portable printer per se is mounted thereon, and a magnetic repulsion and/or a mechanical engagement are utilized to properly orientate and position the printer with respect to the base frame, when mounting the printer on the base frame.

33 Claims, 17 Drawing Sheets

| Fig. 15A |
| --- |
| Fig. 15B |

PAPER FEEDER FOR PORTABLE PRINTER

This application is a continuation of application Ser. No. 08/079,455, filed Jun. 21, 1993, now abandoned, which is a continuation of application Ser. No. 07/827,630, filed Jan. 29, 1992, now abandoned.

BACKGROUND OF THE INVENTION

1) Field of the Invention

The present invention relates to a paper feeder suitable for a hand-carry type portable printer.

2) Description of the Related Art

With the spread of portable personal computers and word-processors, many types of hand-carried portable printers are now widely used, and some of these portable printers can be equipped with a paper feeder. Conventionally, the paper feeder is detachably mounted on or attached to the portable printer at a paper inlet port thereof. In this connection, however, a portable printer equipped with a paper feeder is very unstable, because the portable printer is inherently light and small, and accordingly, the portable printer equipped with the paper feeder is easily unbalanced and the printer and/or the paper feeder are damaged. Therefor, whenever a portable printer with a paper feeder is operated the operator must deal with same carefully and cautiously.

SUMMARY OF THE INVENTION

Therefore, an object of the present invention is to provide a paper feeder for a hand-carry type portable printer, which paper feeder is stably and easily associated with the portable printer.

Another object of the present invention is to provide a paper feeder as mentioned above, whereby feeding of paper can be effectively carried out.

In accordance with the present invention, there is provided a paper feeder suitable for a hand-carry type portable printer and comprising a base frame for detachably mounting the printer thereon; a paper feed means for feeding a sheet of paper to be printed to the printer mounted on the base frame; and an orienting and/or positioning means for properly and forcibly orienting and/or positioning the printer with respect to the base frame and the paper feed means when mounting the printer on the base frame.

In accordance with another aspect of the present invention, there is provided a paper feeder suitable for a hand-carry type portable printer and comprising: a base frame for detachably mounting the printer thereon; a paper feed means for feeding a sheet of paper to be printed to the printer mounted on the base frame, whereby the paper sheet can be printed by the printer; a paper discharge means for discharging the paper sheet from the printer and the base frame after the printing is completed, the paper discharge means being shiftable between a first state in which a discharge of the paper sheet is performed thereby and a second state in which the paper sheet per se merely passes therethrough; a first shifting means for shifting the paper discharge means from the first state to the second state before at least a leading edge of the paper sheet reaches the paper discharge means; and a second shifting means for shifting the paper discharge means from the second state to the first state just after the printing is completed.

In accordance with yet another aspect of the present invention, there is provided a battery pack suitable for a hand-carry type portable printer and comprising a battery pack body having a top surface on which the printer is detachably mounted; and at least two projections provided on the top surface and adapted to be received in at least two recesses provided in the printer, the projections and the recesses being arranged such that the projections can be received in the recesses only when the printer is properly orientated and positioned with respect to the top surface thereof.

BRIEF DESCRIPTION OF THE DRAWINGS

The above and other objects and advantages of the present invention will be better understood from the following description, with reference to the accompanying drawings, in which.

DESCRIPTION OF THE PREFERRED EMBODIMENTS

Figure 1:
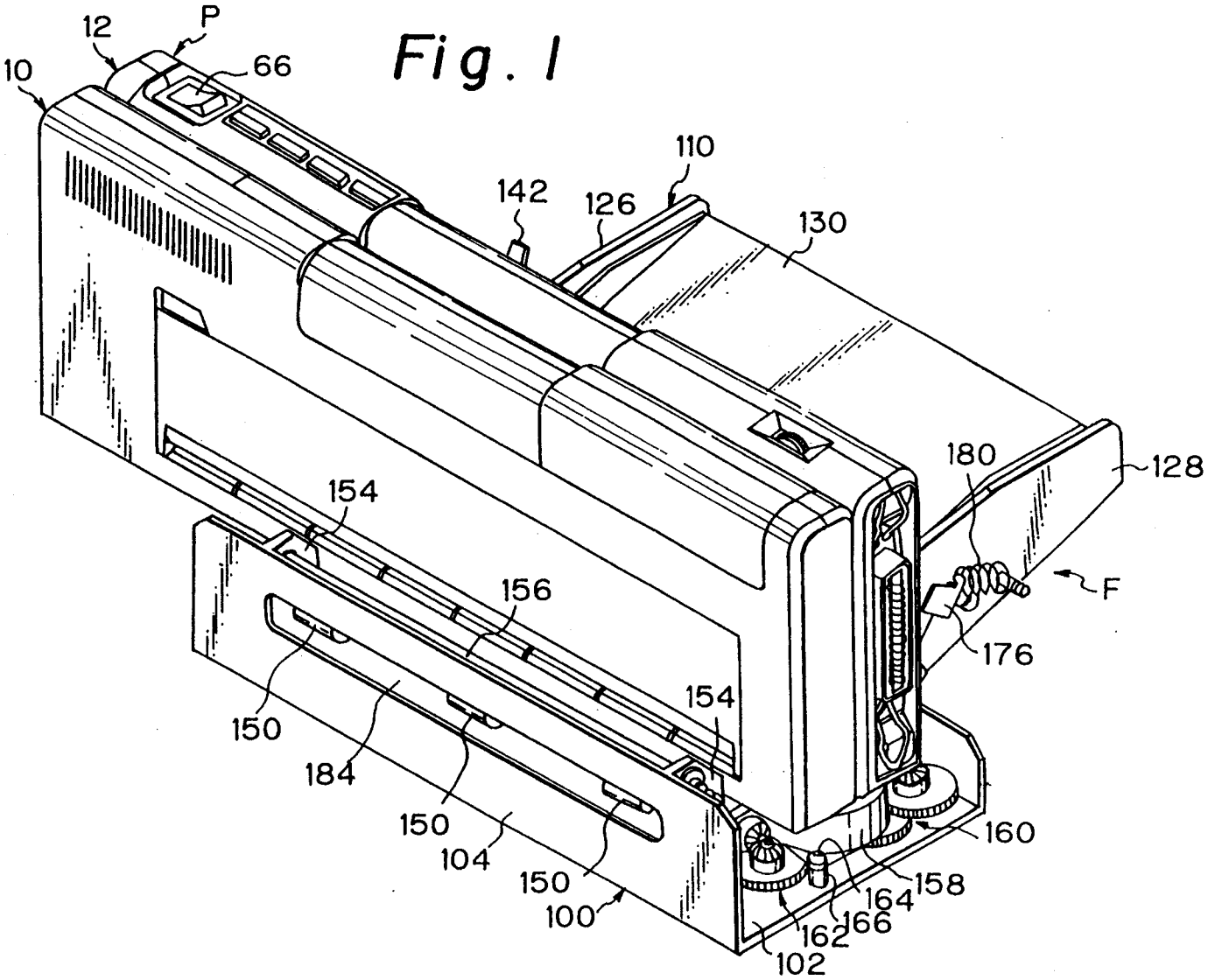
FIG. 1 is a perspective view of a cut sheet paper feeder according to the present invention, and a printer mounted thereon.
Figure 2:
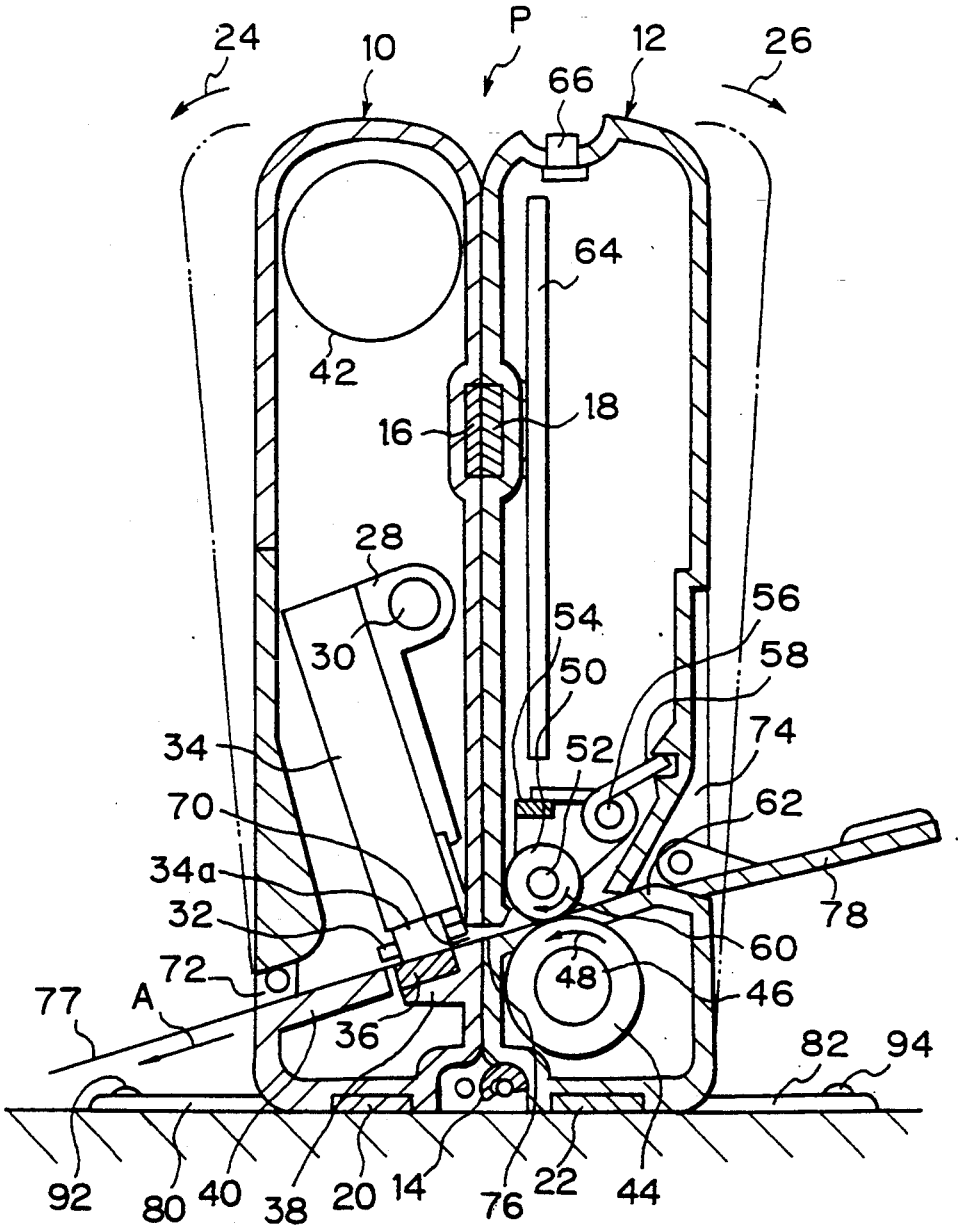
FIG. 2 is a cross-sectional view of the printer shown in FIG. 1.
Figure 3:
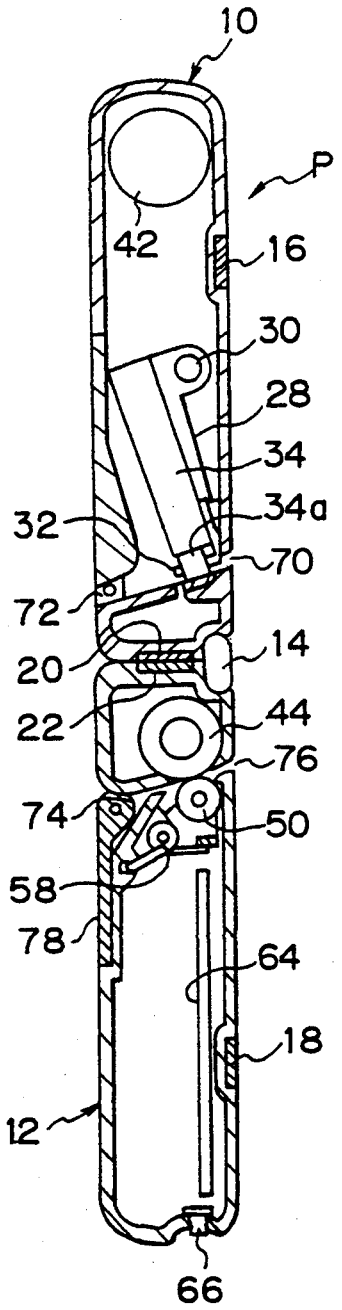
FIG. 3 is a cross-sectional view similar to FIG. 2, showing the printer of FIG. 2 in an open condition.
Figure 4:
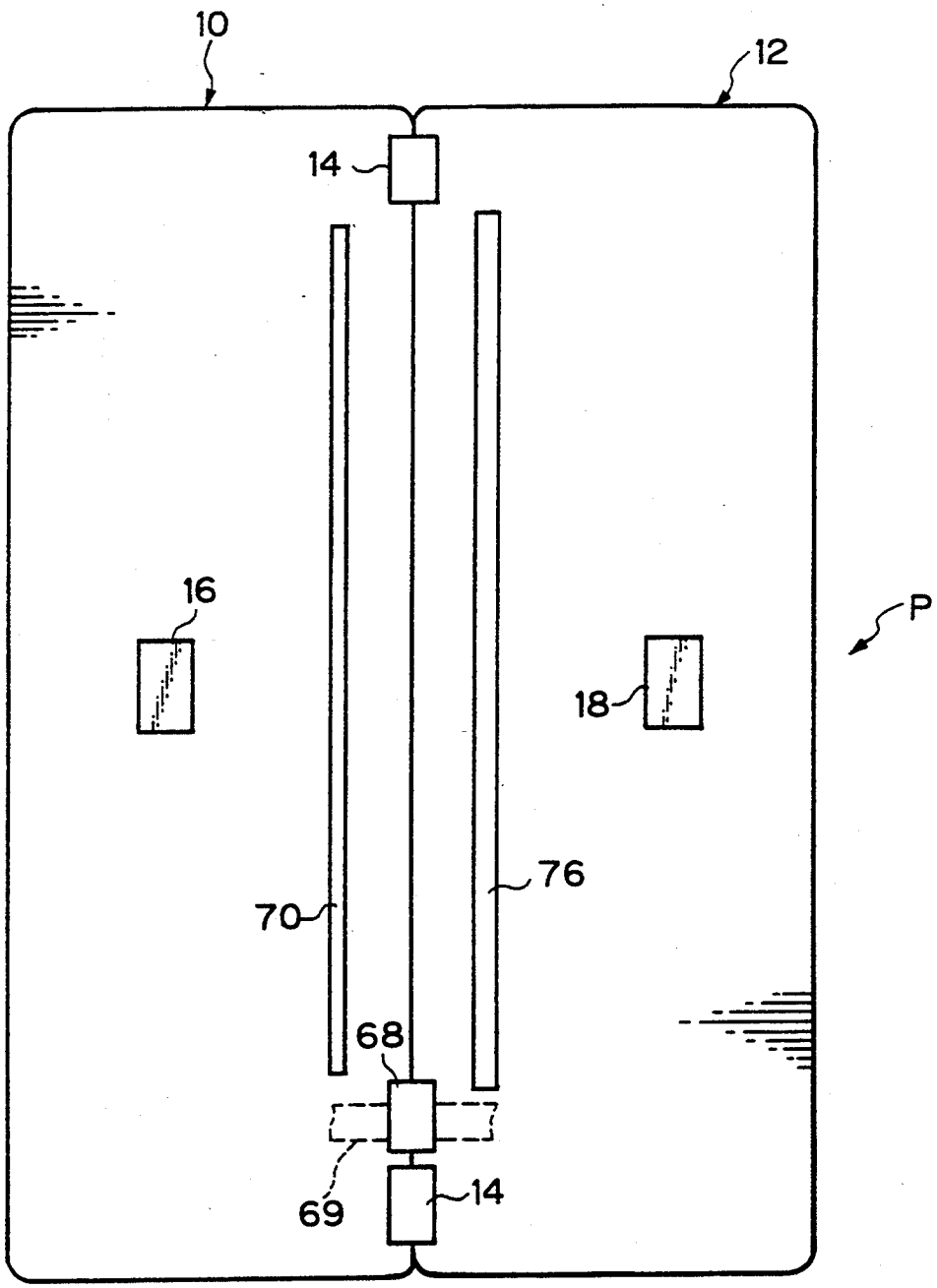
FIG. 4 is a plan view of the printer of FIG. 3.

FIG. 1 shows a cut sheet paper feeder F constructed according to the present invention, and a hand-carry type portable printer P detachably mounted thereon. The portable printer P is especially arranged so as to be convenient for hand-carrying. Namely, the portable printer P comprises two elongated rectangular casings 10 and 12 pivotally connected to each other by hinges 14 provided at the inner side edges of the respective bottoms thereof, as shown in FIG. 2, so that the casings 10 and 12 can be opened as shown in FIGS. 3 and 4; as each of the casings 10 and 12 has a thickness of about one inch, the opened printer P can be easily received in a carrying bag, brief case or the like. Note, when the printer P is used for printing, the casings 10 and 12 are closed, as shown in FIGS. 1 and 2.

Figure 5:
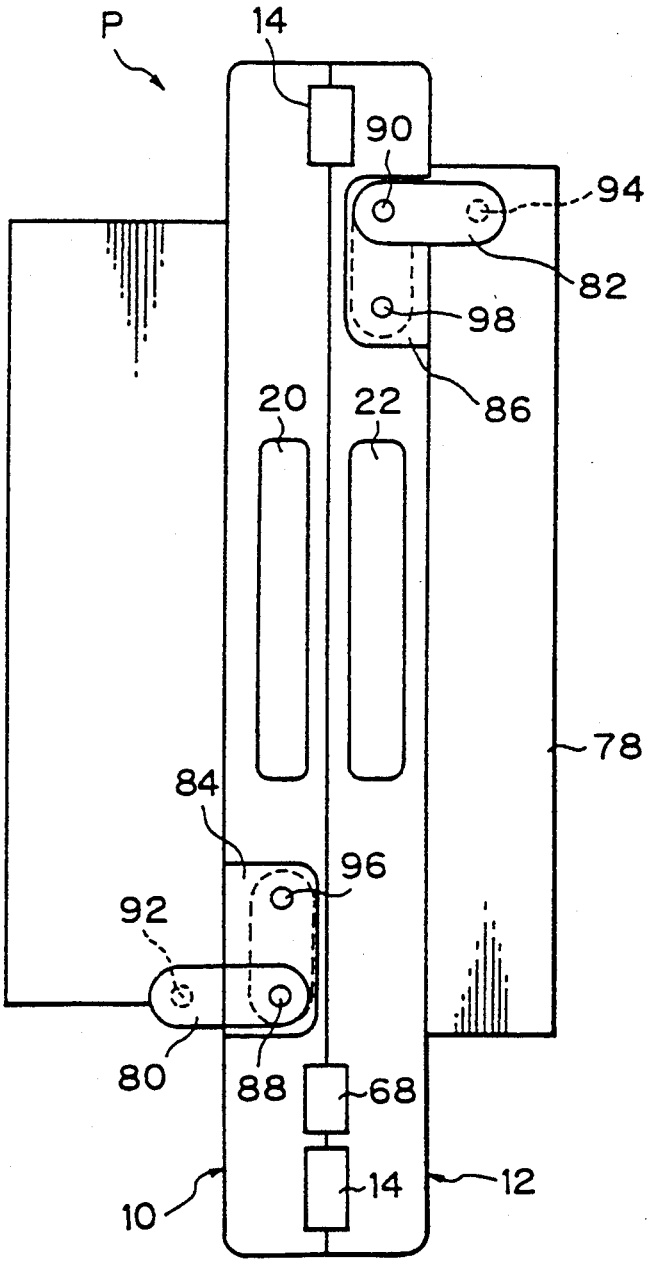
FIG. 5 is a bottom view of the printer of FIG. 2.

The casings 10 and 12 are provided with a steel piece 16 and a magnetic piece 18 held in recesses formed in inner walls of the casings 10 and 12, respectively, these pieces 16 and 18 being in registration with each other when the casings 10 and 12 are closed, whereby the casings 10 and 12 can be magnetically maintained in the closed condition during a printing operation of the printer P. The pieces 16 and 18 are attracted to each other with a suitable magnetic force such that the casings 10 and 12 can be manually and easily separated from each other, as indicated by arrows 24 and 26 in FIG. 2. Note, two magnetic pieces may be held in the recesses formed in the inner walls of the casings 10 and 12, and arranged so as to magnetically attract each other. Also, the casings 10 and 12 are provided with two magnetic strips 20 and 22 held in recesses formed in the bottoms thereof, respectively, as best shown in FIG. 5, and arranged so as to magnetically attract each other when the casings 10 and 12 are in the open position, and thus the casings 10 and 12 can be magnetically maintained in the open condition while carrying the printer P.

As best shown in FIG. 2, the casing 10 includes a carriage 28 movably mounted on a guide shaft 30 extended between and supported by side walls of the casing 10. The carriage 28 is moved along the guide shaft 30 by a suitable electric motor (not shown) such as a pulse motor, servo-motor or the like through the intermediary of a well-known drive mechanism (not shown). Note, the motor and the drive mechanism are housed in the casing 10. The carriage 28 is provided with a thermal printing head 32, and a thermal ink ribbon cassette 34 is detachably mounted on the carriage 28 in such a manner that a thermal ink ribbon portion 34*a*, exposed from the cassette 34, faces the printing face of the head 32. A flat platen 36 is provided in the casing 10 and is held in a recess formed in a shoulder portion 38 which extends integrally from an inner surface of the inner wall of the casing 10, in such a manner that the printing face is in contact with the flat surface of the platen 36. A paper guide member 40 integrally extends from an inner surface of the outer wall of the casing 10 so that a guide surface of the paper guide member 40 is flush with the flat surface of the platen 36. Also, the shoulder portion 38 provides a paper guide surface flush with the flat surface of the platen 36. As apparent from FIG. 2, these paper guide surfaces are sloped downwardly from the inner wall of the casing 10 toward the outer wall thereof. Note, in FIG. 2, reference numeral 42 indicates a symbolically illustrated battery case in which suitable batteries (not shown) are housed.

The casing 12 includes paper feed rollers 44 fixedly mounted on and equally spaced along a shaft 46 which extends between and is rotatably supported by the opposite side walls of the casing 12. The shaft 46 is driven in a direction indicated by an arrow 48 in FIG. 2, by a suitable electric motor (not shown) such as a pulse motor, servo motor or the like, housed in the casing 12. The casing 12 also includes the same number of pressure rollers 50 as and which are resiliently pressed against, the respective paper feed rollers 46. In particular, the pressure rollers 50 are rotatably mounted on and spaced along a shaft 52 at the same pitch as the paper feed rollers 44, and the shaft 52 is then supported by bracket members 54 fixedly mounted on a shaft 56 which extends between and is rotatably supported by the opposite side walls of the casing 12. The shaft 56 is provided with torsion springs 58, each of which has two arms engaged with the corresponding bracket member 54 and the inner wall of the casing 12, respectively, so that each of the pressure rollers 50 is resiliently biased against the corresponding paper feed roller 44. With this arrangement, when the paper feed rollers 44 are driven in the direction indicated by an arrow 48, the pressure rollers 50 can be rotated in a direction indicated by an arrow 60 in FIG. 2. The casing 12 is further provided with paper guide members 62 which extend integrally from an outer wall of the casing 12 to the inner wall thereof and are disposed between two adjacent respective paper feed rollers 46, respectively. Each of the paper guide members 62 has a guide surface slopes downwardly from the outer wall of the casing 12 toward the inner wall thereof; when the casings 10 and 12 are closed, as shown in FIG. 2, the guide surfaces of the paper guide members 62 are flush with the guide surface formed by the shoulder portion 38 of the casing 10. Note, in FIG. 2, reference numeral 64 indicates a control circuit board for controlling printing operations of the printer P, and reference numeral 66 indicates a battery switch button.

As shown in FIG. 4, a dummy hinge 68 is provided at the respective inner side edges of the bottoms of the casings 10 and 12, and a flat flexible electrical cable 69 (a part of which is shown by a broken line) is passed though an inside of the dummy hinge 68 to electrically connect the thermal head 32 and the carriage-drive motor to the control circuit board 64 (FIGS. 2 and 3).

Figure 6:
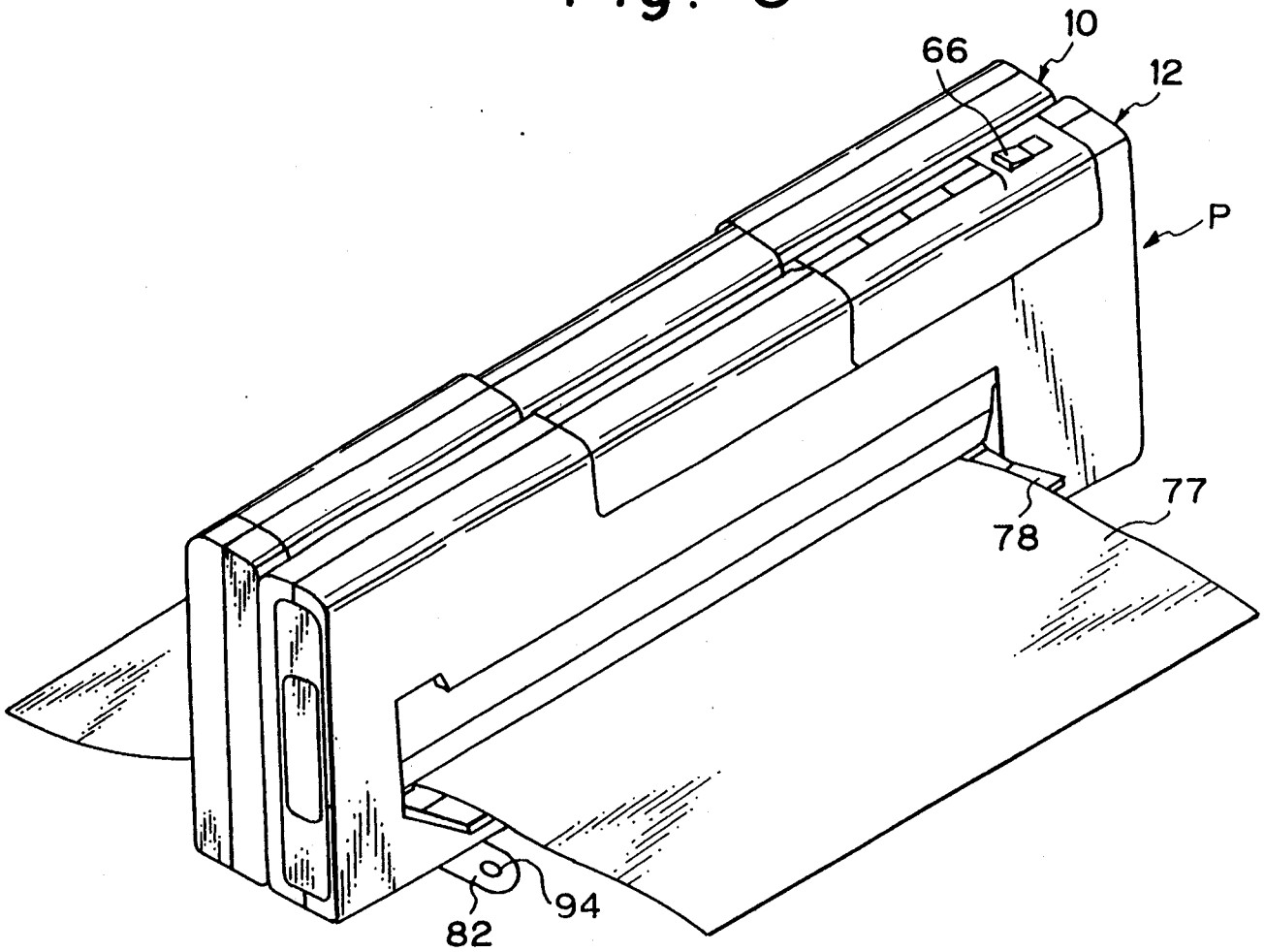
FIG. 6 is a perspective view of the printer of FIG. 2.

As shown in FIG. 3, the casing 10 has elongated openings 70 and 72 formed in the inner and outer walls thereof, respectively, and the casing 12 also has elongated openings 74 and 76 formed in the outer and inner walls thereof, respectively. The opening 74 can be closed by a paper guide tray 78 detachably pivoted to the outer wall of the casing 12 (FIGS. 2 and 5). When the casings 10 and 12 are in the closed position, as shown in FIG. 2, the openings 70 and 76 are in registration with each other, and thus a cut sheet paper 77 can be guided along the above-mentioned paper guide surfaces through the openings 74, 76, 70, and 72, as shown in FIG. 6. While printing is performed line by line thereon, the sheet of precut paper 77 is intermittently fed by the paper feed rollers 44 rotating in a feeding direction indicated by an arrow A in FIG. 2. When the printing is completed, the paper feed rollers 44 are continuously driven so that the paper is discharged from the opening 72.

As best shown in FIG. 5, the casings 10 and 12 are provided with extendable legs 80 and 82 receivable in rectangular recesses 84 and 86 formed in the bottoms of the casings 10 and 12, respectively. In particular, each of the extendable legs 80 and 82 is rotatably attached at one end thereof to the corresponding one of the pivot pins 88, 90 which project from a bottom surface of the recesses 84, 86, and thus can be moved between a first position (shown by a broken line) at which the legs 80, 82 are received in the recesses 84, 86, respectively, and a second position (shown by a solid line) at which the legs 80, 82 extend from the outer bottom edges of the casings 10, 12. As apparent from FIG. 5, rounded projections 92, 94 are formed on an upper surface of the extendable legs 80, 82, respectively, at the free ends thereof. When the extendable legs 80, 82 are received in the recesses 84, 86, the rounded projections 92, 94 are snugly engaged in rounded recesses 96 and 98 formed in the bottom surface of the rectangular recesses 84, 86 so that the extendable legs 80, 82 cannot be arbitrarily moved from the first position (broken line) to the second position (solid line).

When the printer P is set upright on a desk, table or the like, in the closed condition shown in FIGS. 2 and 6, the extendable legs 80 and 82 are extended to ensure a stable position of the printer P. Nevertheless, if a conventional type cut sheet paper feeder is mounted on or attached to the printer P, the printer is not be stable due to the additional weight of the feeder on the printer P.

Accordingly, the cut sheet paper feeder F according to the present invention is arranged so as to receive and hold the printer P as shown FIG. 1, whereby the position of the printer P can be made stable.

Figure 7:
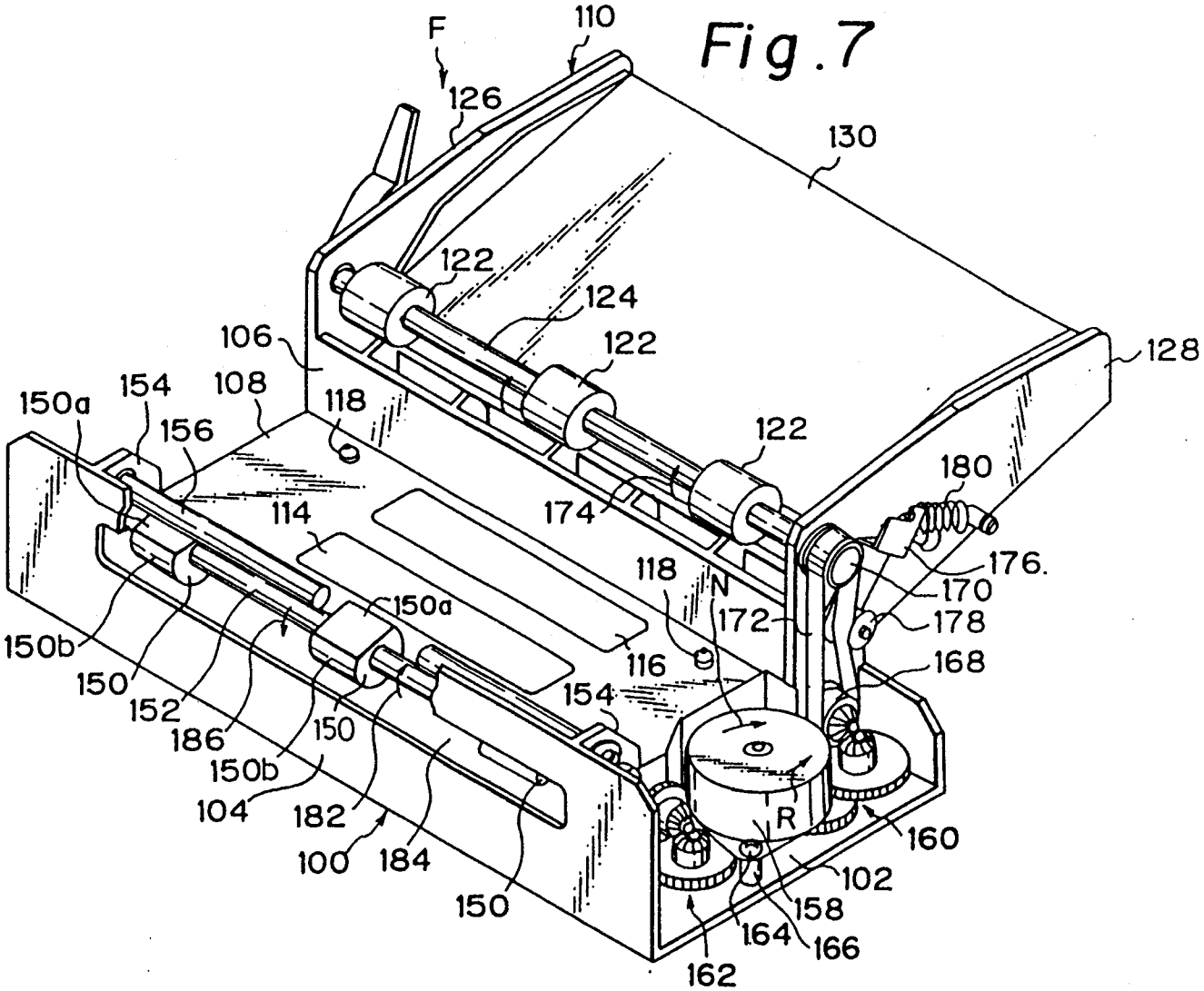
FIG. 7 is a perspective view similar to FIG. 1, but with the printer omitted therefrom.
Figure 11:
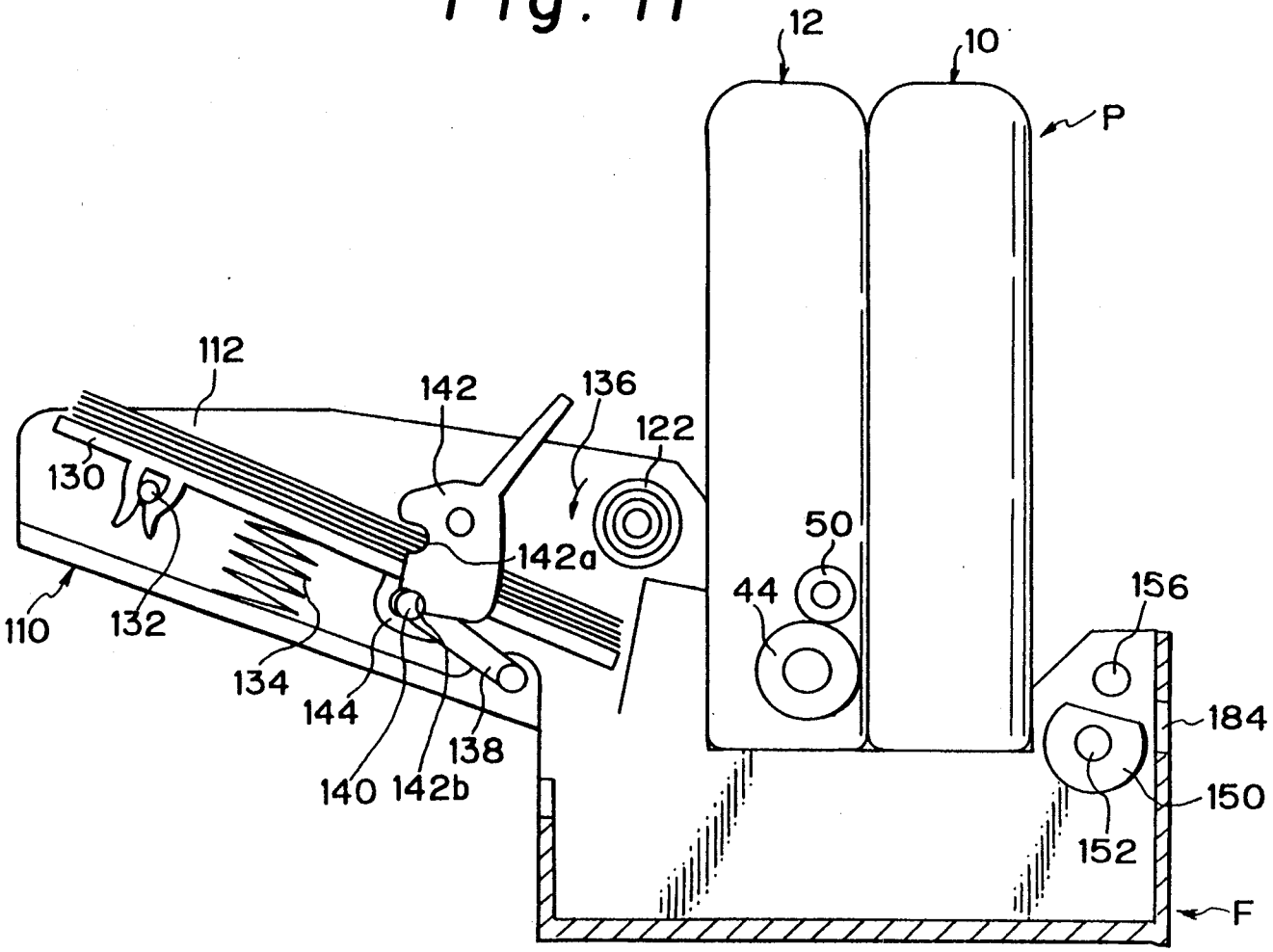
FIG. 11 is a schematic cross-sectional view similar to FIG. 10, but showing a paper feed tray of the paper feeder in a state thereof different from the state shown in FIG. 10.

As best shown in FIG. 7, the paper feeder F comprises a base frame 100 having a rectangular bottom plate 102, a pair of side walls 104 and 106 integrally extending from the longer opposite side edges of the bottom plate 102, and a box-like casing member 108 disposed on the bottom plate 102 and fixed thereon between the side walls 104 and 106. As apparent from FIG. 1, when the printer P is mounted on the base frame 100, a top surface of the casing member serves as a surface for supporting the printer P. As mentioned above, each of the casings 10 and 12 has a thickness of about one inch, and accordingly, the printer P has a thickness of about 2 inches when in the closed condition. Accordingly, in this embodiment, the width of the casing member 108 and the distance between the side walls 104 and 106 are about 2 inches. The paper feeder F also comprises a paper feed tray 110 integrally attached to the side wall 106. A stack of precut paper sheets 112 to be fed is received on the paper feed tray 110 (FIG. 11).

Figure 8:
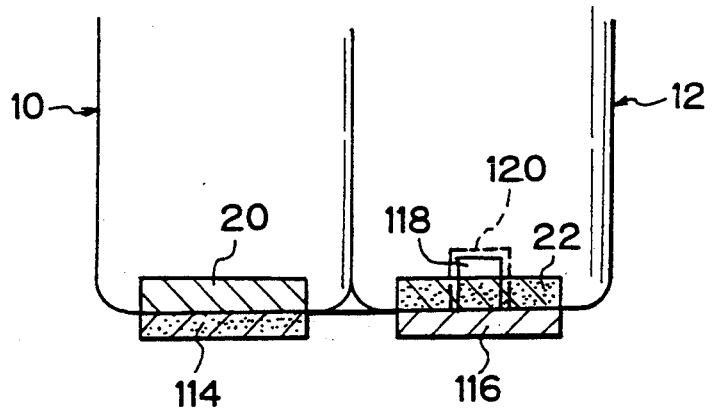
FIG. 8 is a cross-sectional view of a bottom portion of the printer shown in FIG. 1, wherein the printer is correctly oriented and mounted on a base frame of the paper feeder of FIG. 1.
Figure 9:
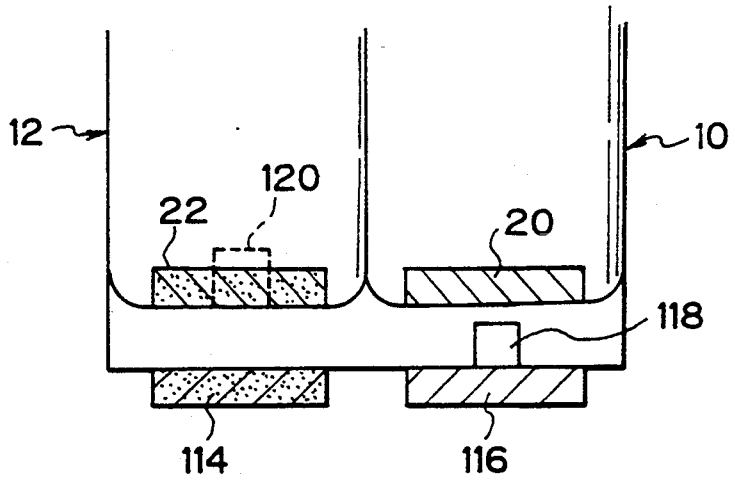
FIG. 9 is a cross-sectional view similar to FIG. 8, but wherein the printer is improperly oriented with respect to the base frame of the paper feeder.

When the printer P is mounted on the base frame 100, it must be correctly oriented so that the outer wall of the casing 12 faces the side wall 106, as shown in FIG. 1, i.e., the opening 74 for introducing the paper to be printed is directed toward the paper feed tray 110. To this end, two magnetic strips 114 and 116 are received and fixed in recesses formed in the top surface of the casing member 108, and are arranged so as to be magnetically attracted by the magnetic strips 20 and 22 of the printer P, respectively. Namely, when the printer P is properly oriented and mounted on the base frame 100, the magnetic strips 114 and 116 (see FIG. 6) face the magnetic strips 20 and 22 of the printer P, respectively, as shown in FIG. 8, and thus a magnetic attraction occurs between the magnetic strips 114 and 116 and the magnetic strips 20 and 22, respectively. Conversely, as shown in FIG. 9, if the printer P is improperly oriented and attempted to be mounted on the base frame 100, so that the outer wall of the casing 10 faces the side wall 106, the magnetic strips 114 and 116 face the magnetic strips 22 and 20, respectively. In this case, a magnetic repulsion occurs between the magnetic strips 114 and 116 and the magnetic strips 22 and 20, respectively. With this arrangement, whenever the printer P is mounted on the base frame 100, a correct orientation of the printer P can be ensured.

To position the printer P in place on the base frame 100, the box-like casing member 108 is provided with positioning projections 118 which project from the top surface thereof, as shown in FIG. 7. In this case, the casing 12 of the printer P has two recesses 120 formed in the bottom thereof (FIGS. 8 and 9), arranged to receive the projections 118 when the printer P is properly oriented and mounted on the base frame 100, as shown in FIG. 8. Note, the projections 118 and the recesses 120 not only position the printer P in place, but also ensure that the printer P is correctly oriented. Namely, when the printer P is improperly oriented, the projections 118 cannot be received in the recesses 120, as shown in FIG. 9. Although not shown, another suitable means for positioning the printer P on the base frame 100 may be used. For example, vertical grooves may be formed in the outer wall surfaces of the casings 10, 12 to receive vertical ridges formed on inner wall surfaces of the side walls 104, 106.

Figure 10:
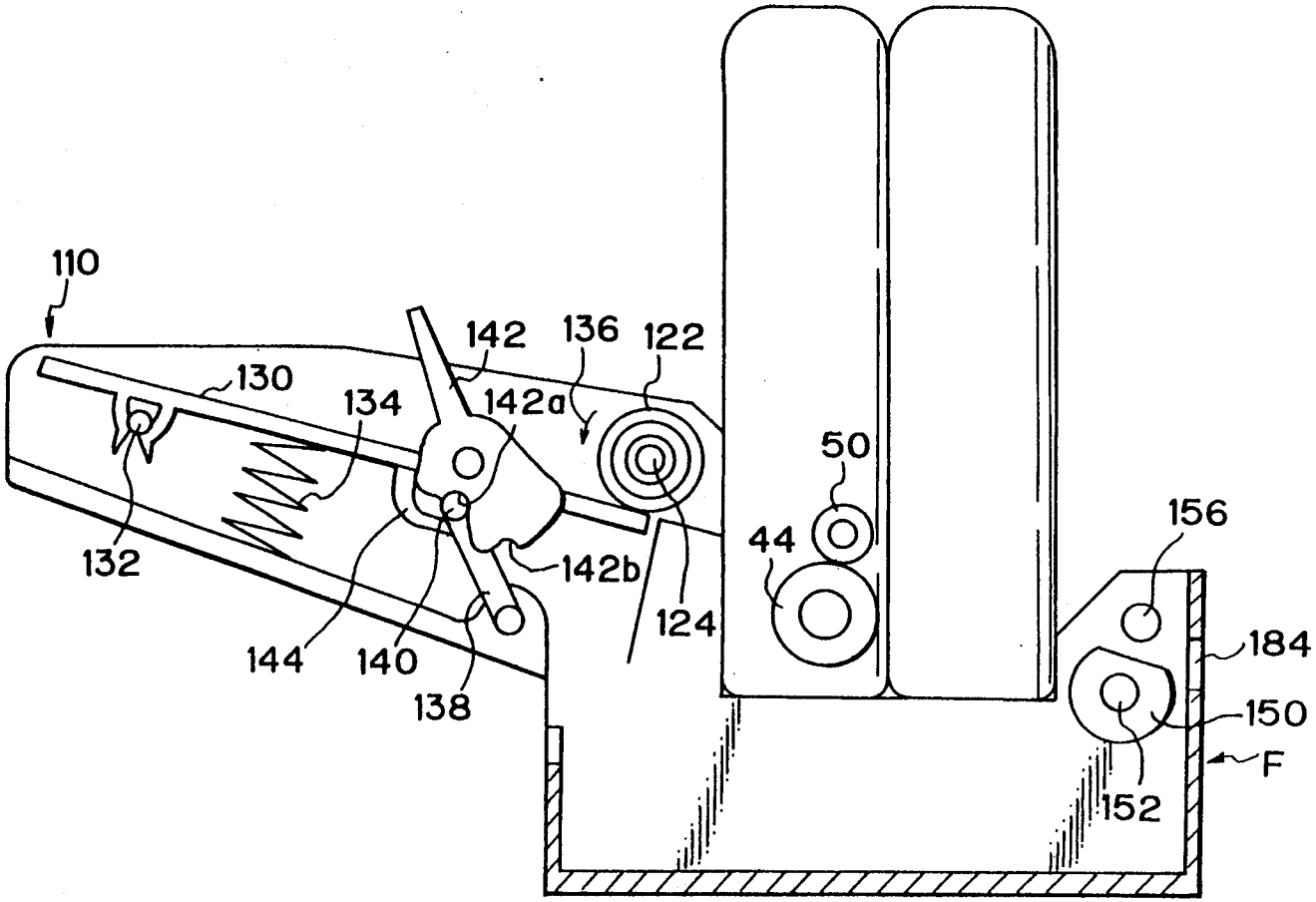
FIG. 10 is a schematic cross-sectional view of the paper feeder and the printer of FIG. 1.

As shown in FIG. 7, the paper feed tray 110 is provided with three paper feed rollers 122 which are fixedly mounted on a shaft 124 rotatably supported by side walls 126 and 128 of the tray 110. Also, the paper feed tray 110 is provided with a movable plate member 130 received therein, as shown in FIG. 10, and the stack of pre-cut paper sheet 112 is placed on the movable plate member 130, as shown in FIG. 11. The plate member 130 is rotatably attached at a rear end portion thereof to pivot pins 132 which project from inner wall surfaces of the side walls 126 and 128, and is lifted about (i.e., raised and rotated about) about the pivot pins 132 by a compressed coil spring 134 restrained between the bottom of the tray 110 and the plate member 130, so that the front end portion of the plate member 130 is resiliently pressed against the paper feed rollers 122, as shown in FIG. 10. Accordingly, the stack of pre-cut paper sheets 112 placed on the plate member 130 also is pressed against the paper feed rollers 122 (FIGS. 13 and 14), and thus the uppermost sheet of the stack of pre-cut paper sheets 112 can be fed therefrom by rotating the paper feed rollers 122 in a direction indicated by an arrow 136.

When the stack of pre-cut paper sheets 112 is placed on the plate member 130, the plate member 130 must be pushed down against of resilient force of the compressed coil spring 134, to thereby separate the front end portion of the plate number 130 from the paper feed rollers 122, and must be held at this lower level before the stack of pre-cut paper sheets 112 can be easily and smoothly placed on the plate member 130 without hindrance by the paper feed rollers 122.

Figure 12:
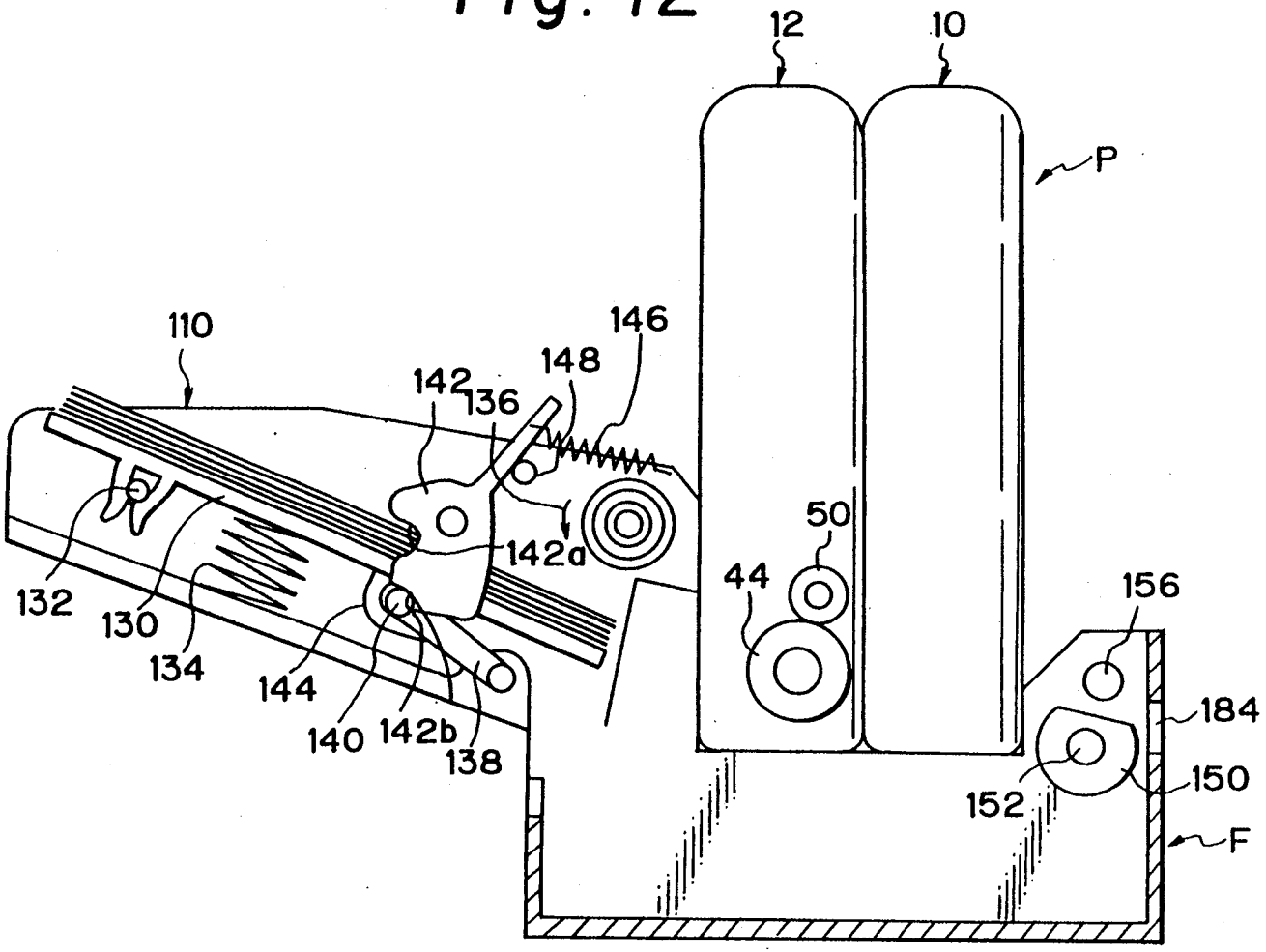
FIG. 12 is a schematic cross-sectional view similar to FIG. 11, but showing a modification of the paper feed tray shown in FIG. 11.

To this end, the paper feed tray 110 is provided with a lock mechanism (FIG. 12) including an arm 138 pivoted at one end thereof to the side wall 126 of the tray 110, a lock pin 140 which extend through a free end of the arm 138, and a lock lever 142 pivoted at a central position to a side wall 126 of the tray 110. An inner portion (not visible) of the lock pin 140 is engaged with a U-shaped member 144 fixedly attached to a lower surface of the plate member 130, and an outer portion of the lock pin 140 is engaged with the lock lever 142, as shown in FIGS. 10 and 11. The lock lever 142 has a cam profile including two notches **142*a* and 142*b*. As apparent from FIG. 10, when the outer portion of the lock pin 140 is engaged with the notch 142*a*, the plate member 130 is in the lifted or raised position at which the front end portion of the plate member 130 is resiliently pressed against the paper feed rollers 122, and when the outer portion of the lock pin 140 is engaged with the notch 142***b*, the plate member 130 is in the lower position at which the front end portion of the plate member 130 is separated from the paper feed rollers 122. Namely, by manually moving the lock lever 142 from the position shown in FIG. 10 to the position shown in FIG. 11, the plate member is lowered and then locked at that lower position, as shown in FIG. 11. Also, as soon as the lock lever 142 is moved from the position shown in FIG. 11 toward the position shown in FIG. 10, the outer portion of the lock pin 140 is disengaged from the notch 142b, and thus the plate member 130 is quickly moved to the lifted position (FIG. 10) due to the resilient force of the compressed coil spring 134.

The plate member 130 may be manually pushed down to the lower position, without using the lock lever 142, and in this case, preferably the lock lever 142 is rotatable in a clockwise direction (FIG. 10) by the force of gravity, whereby the outer portion of the lock pin 140 can be engaged with the notch 142*b*. Alternatively, as shown FIG. 12, the rotation of the lock lever 142 in the clockwise direction may be ensured by the force of a stretched coil spring 146 acting on an arm portion of the lock lever 142. Note, reference 148 indicates a stop pin against which the arm portion of the lock lever 142 is abutted.

As shown in FIG. 7, the paper feeder F further comprises three paper discharge rollers 150 fixedly mounted on a shaft 152 rotatably supported by two bracket members 154 which project from an inner wall surface of the side wall 104 of the base frame 100, and a paper discharge roll member 156 which cooperates with the rollers 150 and is rotatably supported by the bracket members 154 so as to extend in parallel with the shaft 152. Note, in FIG. 7, although a central portion of the roll member 156 is shown to be removed, to thus illustrate the overall appearance of the central roller 150, the roll member 156 is actually extends between the bracket members 154. Each of the paper feed rollers 150 has the generally D-shaped cross section, and thus a circumferential surface of the roller 150 comprises both a flat surface portion 150*a* and a circular surface portion 150*b*. The flat surface portions 150*a* of the rollers 150 are positioned in the same phase. Namely, if one of the flat surface portions 150*a* is extended as a geometrical plane, this geometrical plane includes the other flat surface portions 150*a*. When the paper discharge rollers 150 are rotated, the circular surface portions 150*b* of the rollers 150 are engageable with the paper discharge roll member 156. Namely, the roll member 156 can be rotated only while the circular surface portions 150*b* are engaged with the paper discharge roll member 156.

As apparent from FIG. 7, the box-like casing member 108 is longitudinally shorter than the bottom plate 102, and thus an open space is formed at one end of the base frame 100 for receiving an electric motor 158 such as a pulse motor, servo motor or the like a first gear train 160, and a second gear train 162 therein. The electric motor 158 is attached to the bottom plate 102 by two screws 164 (only one is visible in FIG. 7) through a spacer sleeve 166, and can be driven in normal and reverse directions as indicated by arrows N and R in FIG. 7, respectively. An output gear (not visible) of the motor 158 is engaged with input gears (not visible) of the first and second gear trains 160 and 162.

The first gear train 160 terminates at an output gear thereof, which is carried by a pulley 168 pivoted to the side wall 128 of the paper feed tray 110, and the pulley 168 is operationally connected to a pulley 170 through a drive belt 172. The pulley 170 is mounted on an outer end of the shaft 124 which projects from the side wall 128 of the paper feed tray 110, and is provided with a one-way clutch (not shown) therein. This one-way clutch is arranged so that the shaft 124 can be rotated in only one direction, i.e., as indicated by an arrow 174 in FIG. 7. Namely, the paper feed rollers 122 can be rotated only in the direction indicated by the arrow 136 (FIGS. 10 and 11). The first gear train 160 is arranged so that, when the motor 158 is normally driven in the direction indicated by the arrow N, the pulley 170, and therefore, the shaft 124, are rotated in the direction indicated by the arrow 174. When the motor 158 is reversely driven in the direction indicated by the arrow R, the pulley 170 is reversely rotated, but the shaft 124 cannot be reversely rotated due to the one-way clutch provided in the pulley 170. Namely, the paper feed rollers 122 can be rotated in the normal direction (136) so that the pre-cut paper sheet can be fed, but a rotation of the rollers 122 in the reverse direction is prevented. The drive belt 172 is tensioned by a tension mechanism including a two-armed lever 176 pivoted at the side wall 128 of the paper feed tray 110, a pulley 178 pivoted at and supported by one arm of the two-armed lever 176, and a stretched coil spring 180 acting on the other arm of the two-armed lever 176. As shown in FIG. 7, the pulley 178 is engaged with the drive belt 172 by the spring force of the stretched coil spring 180, so that the drive belt 172 can be always tensioned, and thus a rotational movement can be transmitted from the pulley 168 to the pulley 170.

The second gear train 162 terminates at an output gear carried by an one end of the shaft 156 on which the paper discharge rollers 150 are fixedly mounted, and is arranged so that, when the motor 158 is driven in the reverse direction (R), the shaft 152, and therefore, the paper discharge rollers 150, are rotated in a normal direction as indicated by an arrow 182, whereby the pre-cut paper sheet is discharged from an outlet opening 184 formed in the side wall 104 of the base frame 100. When the motor 158 is driven in the normal direction (N), the paper discharge rollers 150 are rotated in a reverse direction as indicated by an arrow 186.

Figure 13:
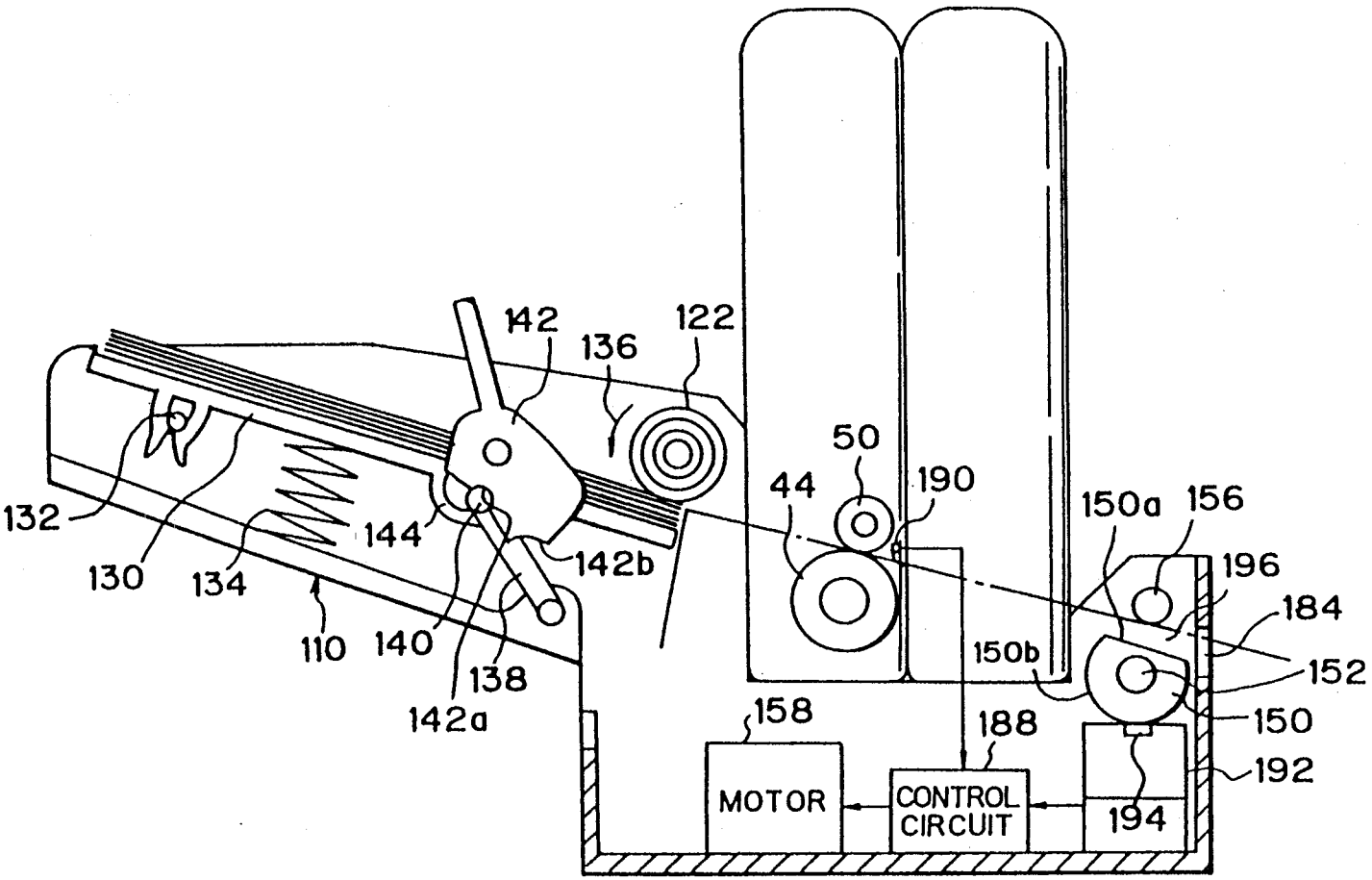
FIG. 13 is a schematic cross-sectional view of the paper feeder and the printer of FIG. 1, together with a block diagram of control components of the paper feeder.
Figure 14:
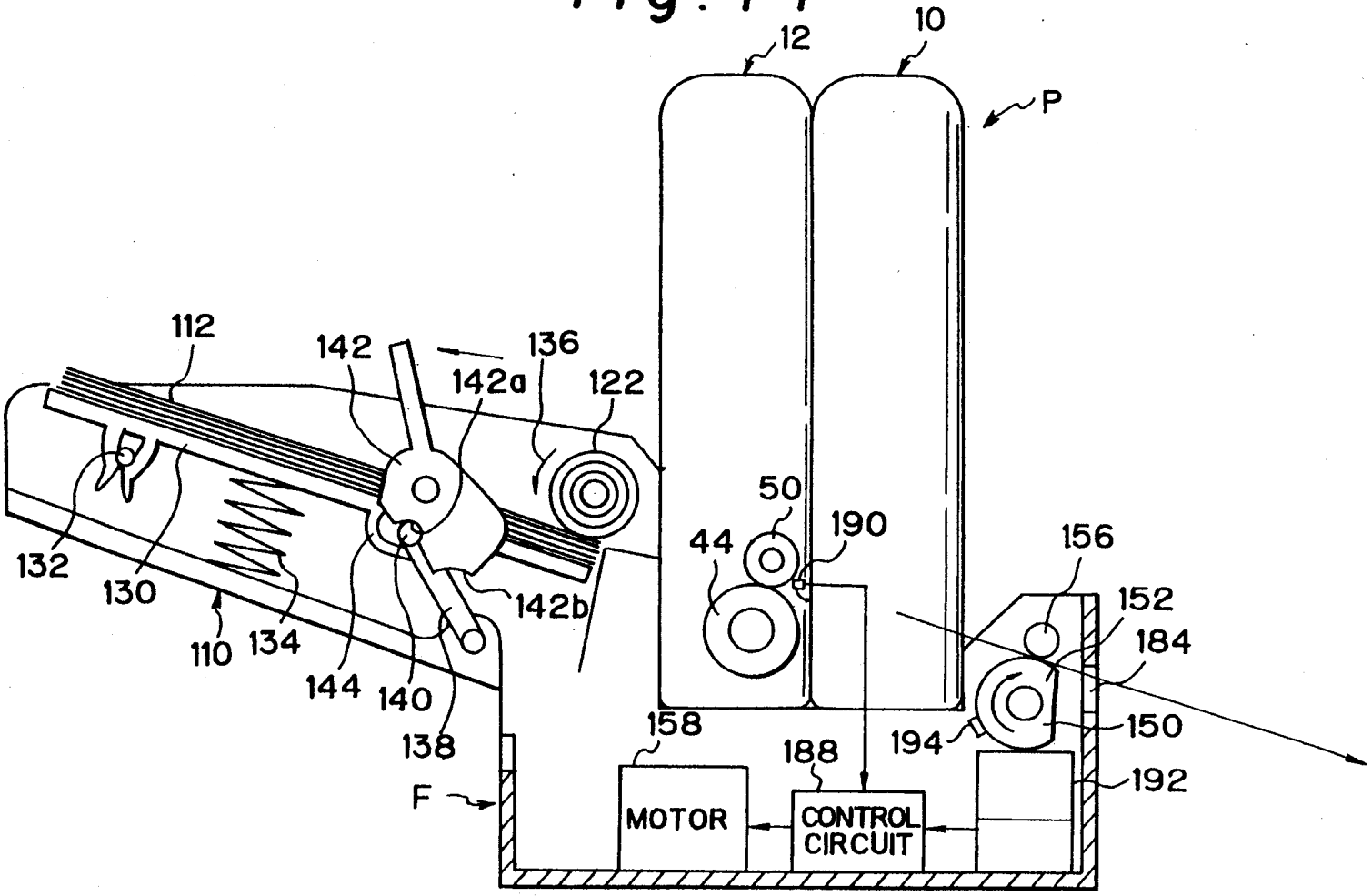
FIG. 14 is a schematic cross-sectional view similar to FIG. 13, but showing a paper discharge roller of the paper feeder at a position thereof different from the position shown in FIG. 13.

Referring to FIGS. 13 and 14, a control circuit 188 for controlling a paper feed operation of the paper feeder F is shown as a block, but the control circuit 188 is actually housed as a control circuit board in the box-like casing member 108. The control circuit board includes a drive circuit for the motor 158 shown as a block in FIG. 13 and 14, and a microcomputer, etc.

The control circuit 188 is electrically connected to a contact switch 190 disposed in the vicinity of the engaging nip between the paper feed rollers 44 and the pressure rollers 50 of the printer P. The contact switch 190 is turned ON when a pre-cut paper sheet passes through the nip between the paper feed rollers 44 and the pressure roller 50. Also, the control circuit 188 is electrically connected to a photo-sensor 112 for detecting the passage of a positioning element 194, which extends from the shaft 152 on which the paper discharge rollers 150 are fixedly mounted. When the positioning element 194 is detected by the photo-sensor 192 during the rotation of the shaft 152, the flat surface portions 150*a* of the paper discharge rollers 150 are directed toward the shaft 152, as shown in FIG. 13.

The photo-sensor 192 includes a light emitting element (not shown) such as an LED, and a light receiving element (not shown) for receiving light emitted from the light emitting element. When the light is interrupted by the positioning element 194, a detecting signal output from the photo-sensor is changed, for example, from a low level to a high level. Although not shown, the control circuit 188 is further electrically connected to the control circuit (64) of the printer P through an interface, so that character code data, and control signals, etc., are fed from the control circuit (64) to the control circuit 188.

Figures 15, 15A:
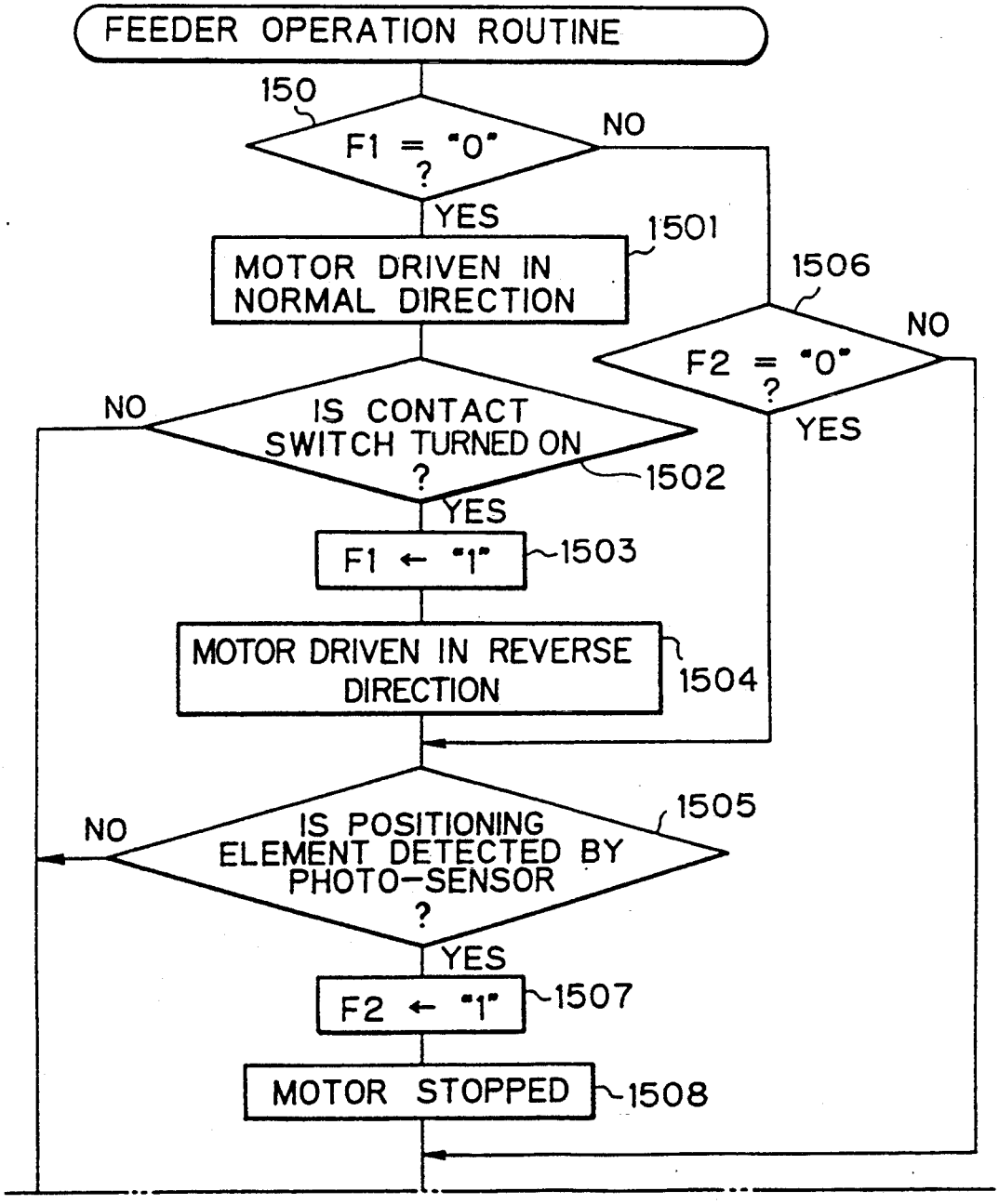
FIGS. 15A and 15B in the composite, comprises a flow chart of the operation of the paper feeder of FIGS. 13 and 14.
Figure 15B:
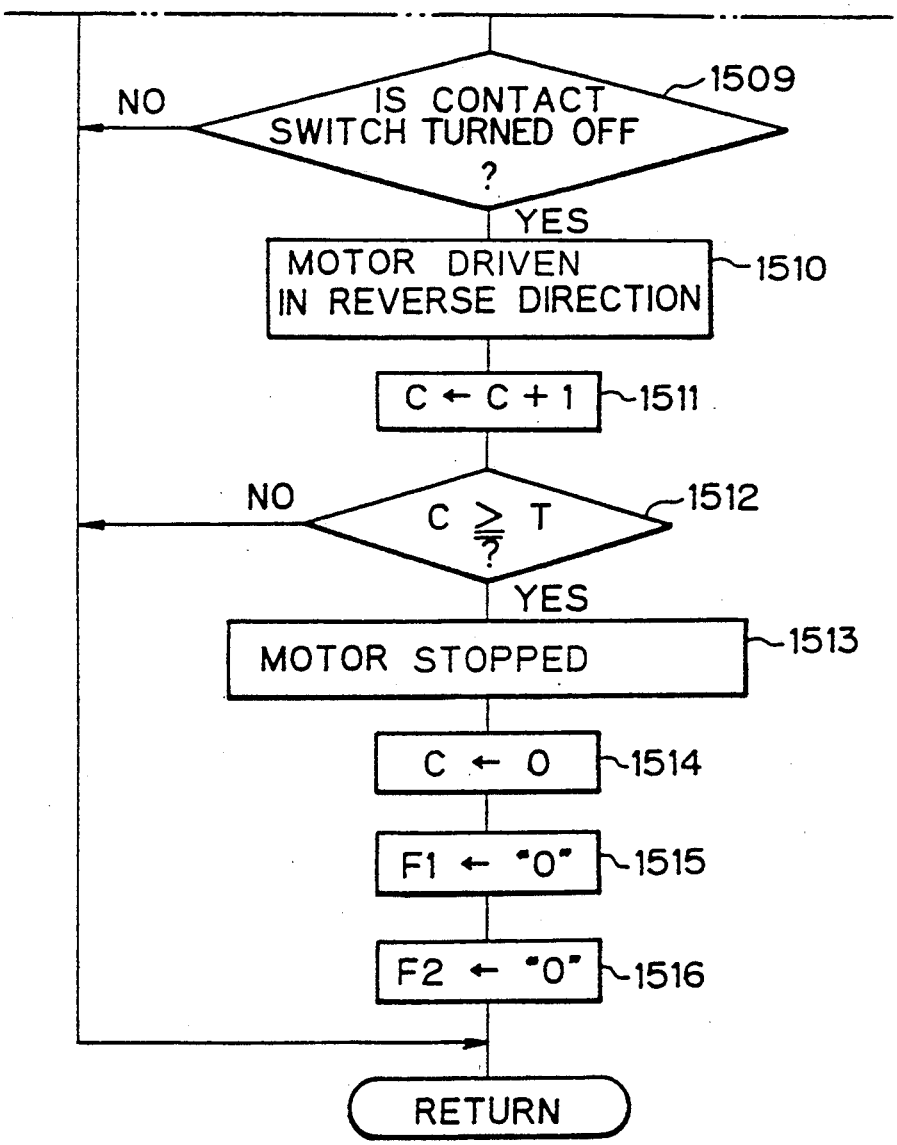
Figure 16:
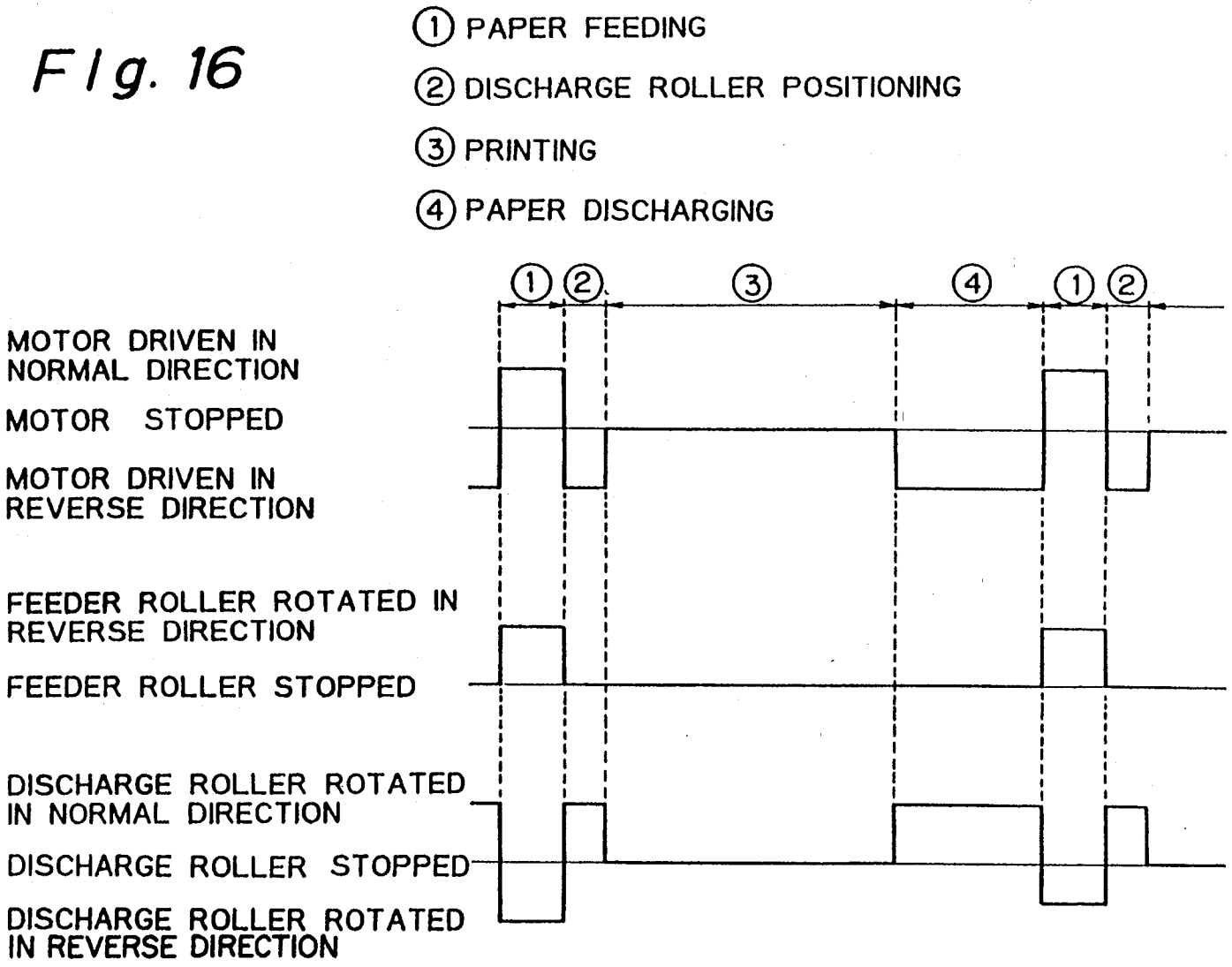
FIG. 16 is a timing chart of the operation of the paper feeder of FIGS. 13 and 14.

The operation of the paper feeder F will now be explained with reference to a feeder operation routine shown in FIGS. 15A and 15B and a time chart shown in FIG. 16. Note, the feeder operation routine is executed by interruptions which are output at very short intervals, for example, 4 ms, and the execution of the routine is started when the control circuit 188 receives a printing-ready signal from the control circuit (64) of the printer P showing that the printer P is ready for printing.

At step 1500, it is determined whether or not a flag F1 is "0" or "1". Since the flag F1 is initially made "0", the control proceeds to step 1501 in which the motor 158 is driven in the normal direction (N), and thus the cut sheet paper is fed from the stack 112 to the printer P by the rotation of the paper feed rollers in the normal direction (136). Then, at step 1502, it is determined whether the contact switch 190 is turned ON. Namely, it is determined whether or not a leading edge of the paper has reached the contact switch 190. At this stage, since the leading edge of the paper has not reached the contact switch 190, the routine is once completed. Thereafter, although the routine is repeatedly executed at intervals of 4 ms, the control does not further proceed until the contact switch 190 is turned ON. Note, during this time, although the paper discharge rollers 150 are rotated in the reverse direction (186), as shown in FIG. 16, there is no paper to be discharged.

At step 1502 and since it is now assumed that the contact switch 190 is turned ON, the control proceeds to step 1503 in which the flag FZ is made "1". Note, after the contact switch 190 is turned ON, the paper Ls printed by the printer P. At step 1504, the motor 158 is driven in the reverse direction (R) so that the rotational direction of the paper discharge rollers 150 is changed from the reverse direction (186) to the normal direction (182), but there is no paper to be discharged at this stage. Then, at step 1505, it is determined whether or not the positioning element 194 is detected by the photo-sensor 192. Note, as mentioned above, the detection of the positioning element 194 is carried out by a change of the output signal of the photo-sensor 192 from the low level to the high level. If the positioning element 194 is not detected by the photo-sensor 192, the routine is once completed. When the routine is executed again after 4 ms, the control proceeds from step 1501 to step 1506 in which it is determined whether a flag F2 is "0" or "1". Since the flag F2 is initially made "0", the control proceeds to step 1505. Thereafter, although the routine is repeatedly executed at intervals of 4 ms, the control does not further proceed until the positioning element 194 is detected by the photo-sensor 192, i.e., the flat surface portions 150*a* of the paper discharge rollers 150 are directed toward the paper discharge roll member 156. Note, during this time, the rotation of the paper feed rollers 122 is stopped due to the one-way clutch provided in the pulley 170, as shown in FIG. 16.

At step 1505, when the positioning element 194 is detected by the photo-sensor 192, the control proceeds to step 1507 in which the flag F2 is made "1". Then, at step 1508, the motor 158 is stopped, and accordingly, the paper discharge rollers 150 are also stopped, so that the flat surface portions 150*a* of the paper discharge rollers 150 are directed toward the paper discharge roll member 156, and thus a space 196 is formed between the paper discharge rollers 150 and the paper discharge roll member 156, as shown in FIG. 13. At step 1509 (FIG. 15B), it is determined whether or not the contact switch 190 is turned OFF, i.e., the printing by the printer p is completed. If the printing is not completed, the routine is once completed. When the routine is again executed after 4 ms, the control proceeds from step 1501 to step 1509 through step 1506 F2="0". Thereafter, although the routine is repeatedly executed at intervals of 4 ms, the control does not further proceed until the printing is completed.

During the printing operation, the paper is moved by the paper feed rollers 44 and the pressure rollers 50 of the printer P toward the outlet opening 184 formed in the side wall 104 of the base frame 100, and the forward portion of the paper is extended from the outlet opening 184 through the space 196 just before the printing is completed. It can be easily understood that the formation of the flat surface portions 150*a* on the paper discharge rollers 150 is directed toward the passage of the paper between the paper discharge rollers 150 and the paper discharge roll member 156 during the printing operation.

At step 1509, if the contact switch 190 is turned OFF, i.e., if the printing is completed, the control proceeds to step 1510 in which the motor is driven in the reverse direction (R) so that the paper discharge rollers 150 are rotated in the normal direction (182). Accordingly, the circular surface portions 150*b* of the rollers 150 are engaged with the paper discharge roll member 156, through the intermediary of the paper, whereby the paper is moved by the rotation of the rollers 150 and thereby discharged from the outlet opening 184. At step 1511, a counter C is incremented by 1, and at step 1512, it is determined whether or not the count number of the counter C is larger than a number T corresponding to a time sufficient for the complete discharge of the paper by the rotation of the paper discharge rollers 150. For example, if it takes two seconds to completely discharge the paper from the outlet opening 184, the number T is made 500 (2000/4). At this stage, since the count number of the counter C has not reached 500, the routine is once completed. Thereafter, although the routine is repeatedly executed at intervals of 4 ms, the control does not further proceed until the count number of the counter C reaches 500.

At step 1512, when the count number of the counter C reaches 500, the control proceeds to step 1513 in which the motor 158 is stopped. Then, at the step 1514, the counter C is reset, and at steps 1515 and 1516, the flags F1 and F2 are made "0".

When the control circuit 188 again receives the printing-ready signal from the control circuit (64) of the printer P, the paper is fed to and discharged from the printer P in the manner as mentioned above.

As apparent from the foregoing, since the drive motor 158 is commonly used for driving the paper feed rollers 122 and the paper discharge rollers 150, the paper feeder F can be compactly constructed.

Note, in the embodiment as mentioned above, although the control circuit 188 includes the microcomputer for controlling the drive circuit for the motor 158, this drive circuit may be controlled by the controller 64 of the printer P, in which case the microcomputer can, of course, be omitted from the control circuit 188.

Figure 17B:
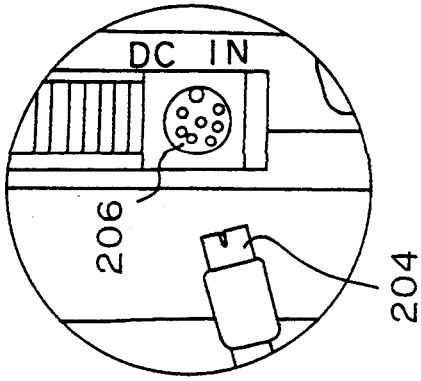
FIG. 17B is an partially enlarged side view of the printer of FIG. 17A.
Figure 17A:
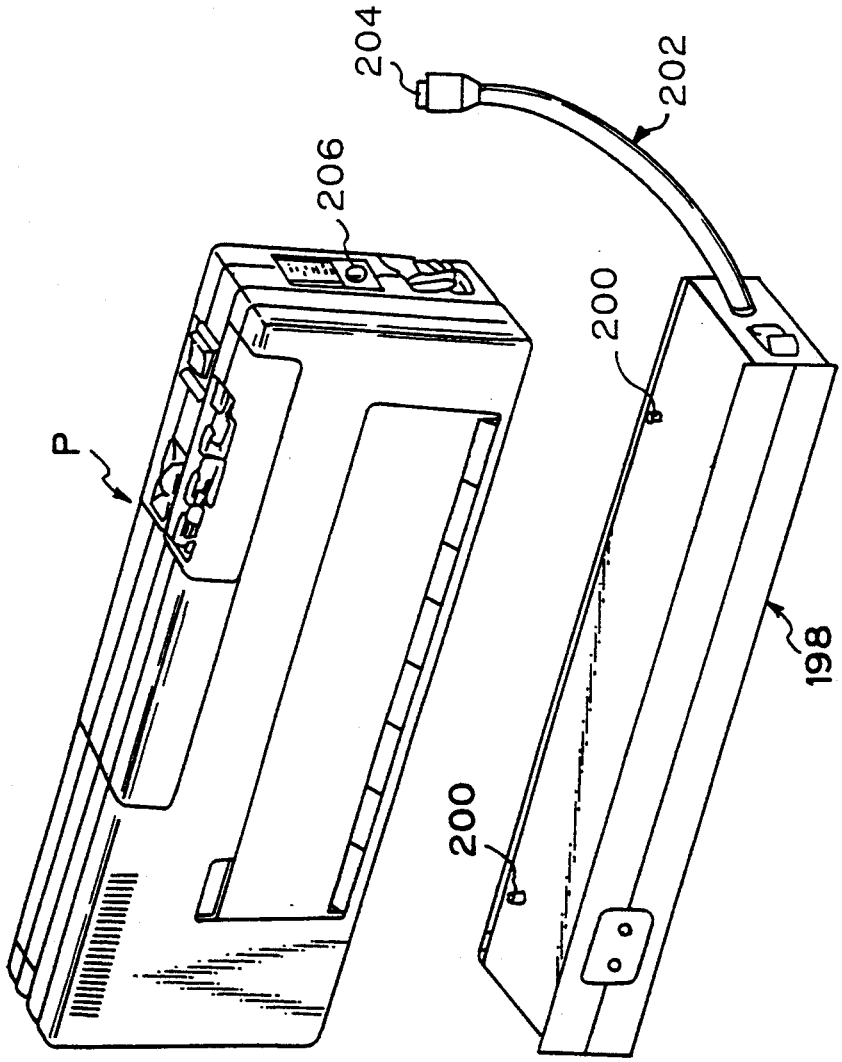
FIG. 17A is a perspective and exploded view of a rechargeable battery pack useable with and on which the printer is mounted.

FIG. 17A shows a re-chargeable battery pack 198 on which the printer P can be mounted. When the printer P is mounted on the battery pack 198, it must be correctly oriented and positioned with respect to the battery pack, and to this end, positioning recesses 120 formed in the bottom of the printer casing 12 are utilized. In particular, the battery pack 198 is provided with positioning projections 200 formed on a top surface thereof and arranged in the same manner as the projections 118 formed on the top surface of the box-like casing member 108. The battery pack is also provided with a power supply cord 202 having a connector 204 at a free end thereof. After the printer P is mounted on the battery pack 198, the connector 204 of the power supply cord 202 is joined to a socket 206 provided in a side wall of the printer casing 12, as best shown in FIG. 17B.

Finally, it will be understood by those skilled in the art that the foregoing description is of the preferred embodiments of the disclosed device, and that various changes and modifications may be made to the present invention without departing from the spirit and scope thereof.

We claim:

1. A paper feeder for operative assembly with a hand-carryable portable printer, comprising:

base frame means for positioning on a support structure and for detachably mounting said printer on top thereof and thereby supporting said printer on top thereof and relative to said support structure, said printer including a wall member having a paper introduction opening therein, the wall member being supported in an upright position when the printer is mounted on top of said base frame means;

paper feed means, incorporated in said base frame means, for feeding a sheet of paper to be printed to said printer through said paper introduction opening in said wall member of said printer when said printer is mounted on top of said base frame means; and orientation requirement means for requiring a proper orientation of said printer relative to said base frame means thereby to permit the mounting of said printer on top of said base frame means.

2. A paper feeder as set forth in claim 1, wherein said orientation requirement means comprises magnetic means for magnetically requiring the proper orientation of said printer with respect to said paper feed means to permit mounting of said printer on said base frame means.

3. A paper feeder as set forth in claim 2, wherein at least one magnetic element is provided on said printer, said magnetic means further comprising at least one magnetic element provided on said base frame means and disposed to be in alignment with and magnetically attracted to the respective, said at least one magnetic element provided on said printer when properly oriented for mounting on said base frame means, the respective magnetic elements of said base frame means said printer magnetically repelling each other when said printer is improperly oriented, relatively to said base frame means, for being mounted on said base frame means.

4. A paper feeder as set forth in claim 1, wherein said orientation requirement means comprises mechanical means for mechanically preventing the mounting of said printer on said base frame means when said printer is not in the proper orientation, relatively to said base frame means, required for permitting the mounting of the printer on the top of the base frame means and for permitting the mounting of the said printer on the top of said base frame means when said printer is in the proper orientation, relative to said base frame means, to permit said mounting of said printer thereon.

5. A paper feeder as set forth in claim 4, wherein said mechanical means comprises a projection provided on said base frame means and adapted to be received in a recess provided in said printer when said printer is in the proper orientation, required to permit mounting of said printer on the top of said base means, said recess being out of alignment with said projection when said printer is not in the proper orientation, relatively to said base frame means, required to permit mounting of said printer on the top of said base frame means.

6. A paper feeder as set forth in claim 1, wherein said paper feed means comprises a paper feed roller, a movable plate member for receiving a stack of paper sheets thereon, spring means for resiliently lifting said plate member and thereby to resiliently press said stack of papers against said paper feed roller for feeding the uppermost paper sheet from said stack of paper sheets by the paper feed roller, and lock means for releasably locking said plate member in a lowered position when said plate member is lowered against the resilient lifting force of said spring means, whereby said stack of paper sheets can be easily placed on said movable plate member.

7. A paper feeder as set forth in claim 6, wherein said lock means comprises a manual lever movable between a lock position in which said plate member is locked in said lowered position and a release position in which the manual lever releases said plate member from the locked, lowered position.

8. A paper feeder as set forth in claim 7, wherein said lever is arranged so that said lever is moved from said release position to said lock position by the force of gravity when said plate member is manually lowered to said lowered position against the resilient force of said spring means.

9. A paper feeder as set forth in claim 7, further comprising lever spring means for resiliently moving said plate member from said release position to said lock position when said plate member is manually lowered to said lowered position against the resilient force of said spring means.

10. A paper feeder as set forth in claim 1, wherein said printer comprises first and second elongated rectangular casings pivotally connected to each other by a hinge provided at the inner side edges of the respective bottoms of the casings, so that said first and second casings are moveable to a closed, facing relationship in registration with each other, each of said first and second casings having a thickness of about one inch so that when closed and registered, said first and second casings have a total thickness of about two inches, and wherein said base frame means is arranged so as to receive the bottoms of the closed and registered first and second casings.

11. A paper feeder suitable for a hand-carryable portable printer, comprising:

base frame means for positioning on a support structure and detachably mounting said printer thereon and thereby supporting said printer relative to said support structure, said printer including a wall member having a paper introduction opening therein, the wall member being supported in an upright position when the printer is mounted on said base frame means;

paper feed means, incorporated in said base frame means, for feeding a sheet of paper to be printed to said printer through said paper introduction opening therein when said printer is mounted on said base frame means; and orienting and positioning requirement means for requiring a proper orientation and positioning of said printer relative to said base frame means thereby to permit the mounting of said printer on said base frame means.

12. A paper feeder as set forth in claim 11, wherein said orienting and positioning requirement means comprises mechanical means for mechanically preventing the mounting of said printer on said base frame means when said printer is not in the proper orientation, relatively to said base frame means, required for permitting the mounting of the printer on the base frame means and for permitting the mounting of the said printer on said base frame means when said printer is in the proper orientation relative to said base frame means to permit said mounting of said printer thereon.

13. A paper feeder as set forth in claim 12, wherein said mechanical means comprises at least two projections provided on said base frame means and adapted to be received in respective, at least two recesses provided in said printer when said printer is in the proper orientation, required to permit mounting of said printer on said base means, and said at least two recesses being out of alignment with said respective at least two projections when said printer is not in the proper orientation, relatively to said base frame means, required to permit mounting of said printer on said base frame means.

14. A paper feeder as set forth in claim 11, wherein said paper feed means comprises a paper feed roller, a movable plate member for receiving a stack of paper sheets thereon, spring means for resiliently lifting said plate member and thereby to resiliently press said stack of papers against said paper feed roller for feeding the uppermost paper sheet from said stack of paper sheets by the paper feed roller, and lock means for releasably locking said plate member in a lowered position when said plate member is lowered against the resilient lifting force of said spring means, whereby said stack of paper sheets can be easily placed on said movable plate member.

15. A paper feeder as set forth in claim 14, wherein said lock means comprises a manual lever movable between a lock position in which said plate member is locked in said lowered position and a release position in which the manual lever releases said plate member from the locked, lowered position.

16. A paper feeder as set forth in claim 15, wherein said lever is arranged so that said lever is moved from said release position to said lock position by the force of gravity when said plate member is manually lowered to said lowered position against the resilient force of said spring means.

17. A paper feeder as set forth in claim 15, further comprising lever spring means for resiliently moving said plate member from said release position to said lock position when said plate member is manually lowered to said lowered position against the resilient force of said spring means.

18. A paper feeder as set forth in claim 11, wherein said printer comprises first and second elongated rectangular casings pivotally connected to each other by a hinge provided at the inner side edges of the respective bottoms of the casings, so that said first and second casings are moveable to a closed, facing relationship in registration with each other, each of said first and second casings having a thickness of about one inch so that when closed and registered, said first and second casings have a total thickness of about two inches, and wherein said base frame means is arranged so as to receive the bottom of the closed and registered first and second casings.

19. A paper feeder as set forth in claim 11, wherein said orientation requirement means comprises magnetic means for magnetically requiring the proper orientation of said printer with respect to said paper feed means, to permit mounting of said printer on said base frame means.

20. A paper feeder as set forth in claim 19, wherein at least one magnetic element is provided on said printer, said magnetic means further comprising at least one magnetic element provided on said base frame means and disposed to be in alignment with and magnetically attracted to the respective, said at least one magnetic element provided on said printer when properly oriented for mounting on said base frame means, the respective magnetic elements of said base frame means base said printer magnetically repelling each other when said printer is improperly oriented, relatively to said base frame means, for being mounted on said base frame means.

21. A paper feeder as recited in claim 11, wherein the base frame means has a top portion and detachably mounts the printer, and thereby supports the printer, on the top portion thereof, the wall member being supported in the upright position when the printer is mounted on the top portion of said base frame means.

22. A paper feeder suitable for a hand-carryable portable printer, comprising:

base frame means for detachably mounting said printer thereon, said printer including a wall member having a paper introduction opening therein, the wall member being supported in an upright position when the printer is mounted on said base frame means;

paper feed means, incorporated in said base frame means, for feeding a sheet of paper to be printed by said printer through said paper introduction opening when said printer is mounted on said base frame means; and magnetic means for requiring a proper orientation of said printer, relatively to said base frame means, thereby to permit the mounting of the printer on the base frame means, said magnetic means including at least a first magnetic element on said base frame means and at least a second magnetic element on said printer respectively and relatively disposed to be in mutual alignment with each other and thereby magnetically attracted to each other when said printer is properly oriented for being mounted on said base frame means, said first and second magnetic elements magnetically repelling each other when said printer is improperly oriented relatively to said base frame means for being mounted thereon.

23. A paper feeder as set forth in claim 22, wherein said paper feed means comprises a paper feed roller, a movable plate member for receiving a stack of paper sheets thereon, spring means for resiliently lifting said plate member and thereby to resiliently press said stack of papers against said paper feed roller for feeding the uppermost paper sheet from said stack of paper sheets by the paper feed roller, and lock means for releasably locking said plate member in a lowered position when said plate member is lowered against the resilient lifting force of said spring means, whereby said stack of paper sheets can be easily placed on said movable plate member.

24. A paper feeder as set forth in claim 23, wherein said lock means comprises a manual lever movable between a lock position in which said plate member is locked in said lowered position and a release position in which the manual lever releases said plate member from the locked, lowered position.

25. A paper feeder as set forth in claim 24, wherein said lever is arranged so that said lever is moved from said release position to said lock position by the force of gravity when said plate member is manually lowered to said lowered position against the resilient force of said spring means.

26. A paper feeder as set forth in claim 24, further comprising lever spring means for resiliently moving said plate member from said release position to said lock position when said plate member is manually lowered to said lowered position against the resilient force of said spring means.

27. A paper feeder as set forth in claim 22, wherein said printer comprises first and second elongated rectangular casings pivotally connected to each other by a hinge provided at the inner side edges of the respective bottoms of the casings, so that said first and second casings are moveable to a closed, facing relationship in registration with each other, each of said first and second casings having a thickness of about one inch so that when closed and registered, said first and second casings have a total thickness of about two inches, and wherein said base frame means is arranged so as to receive the bottoms of the closed and registered first and second casings.

28. A paper feeder as recited in claim 22, wherein the base frame means has a top portion and detachably mounts the printer, and thereby supports the printer, on the top portion thereof, the wall member being supported in the upright position when the printer is mounted on the top portion of said base frame means.

29. In combination:

a hand-carried portable printer having a printer base and a sidewall, generally perpendicular to the printer base, the printer sidewall having a paper sheet feed opening therein for receiving therethrough a sheet of paper to be printed by the printer; and a paper feeder adapted for operative assembly with the portable printer and comprising:

a base frame comprising a base member and at least one sidewall member which is substantially perpendicular to the base member and thereby is disposed vertically when the base member is disposed horizontally, the base member having a support surface and the sidewall member having a first surface disposed toward the support surface of the base member and a second, opposite surface remote from the support surface of the base member, and a paper feed element extending laterally from the second surface of the sidewall member of the base frame and upwardly, angularly inclined relatively to the base member when disposed horizontally, the paper feed element defining a paper sheet feed path; and orientation means, disposed at least in the base member of the base frame, for requiring a proper orientation of the printer, relatively to the base member support surface, to permit mounting the portable printer on the base member support surface with the printer base received on and supported by the base member support surface with the printer sidewall disposed substantially parallel and adjacent to the first surface of the vertically disposed sidewall member and with the paper feed opening of the printer sidewall aligned with the paper sheet feed path.

30. A paper feeder as recited in claim 29, wherein the orientation means further comprises:

a first orientation element disposed in the base member of the base frame; and a second orientation element disposed in the printer base and positioned therein so as to be aligned, in cooperative association with the first orientation element when the printer is properly oriented for being mounted on the base member-support surface and for precluding mounting of the printer, when improperly oriented, on the base member support surface.

31. A paper feeder as recited in claim 30, wherein the first and second orientation elements comprise respective magnetic elements disposed relatively to each other so as to magnetically attract and repel each other when the printer is, respectively, properly oriented and not properly oriented, for being mounted on the base member support surface.

32. A paper feeder as recited in claim 30, wherein the second orientation element comprises at least one recess in the printer base and the first orientation element comprises at least one corresponding projection which extends vertically, relatively to the base member support surface when the base member support surface is disposed horizontally, which is in alignment with the at least one recess in the printer base when the printer is properly oriented and positioned for being mounted on the base member support surface and which is received within the at least one recess to permit mounting of the printer on the base member support surface, the at least one projection being non-aligned with the corresponding at least one recess and preventing mounting of the printer on the base member support surface when the printer is not properly oriented and positioned for being mounted on the base member support surface.

33. A paper feeder as recited in claim 29, wherein the base frame means has a top portion and detachably mounts the printer, and thereby supports the printer, on the top portion thereof, the wall member being supported in the upright position when the printer is mounted on the top portion of said base frame means.

* * * * *

UNITED STATES PATENT AND TRADEMARK OFFICE

CERTIFICATE OF CORRECTION

PATENT NO. : 5,423,529

DATED : June 13, 1995

INVENTOR(S) : SAITO et al.

It is certified that error appears in the above-indentified patent and that said Letters Patent is hereby corrected as shown below:

Col. 1, line 57, delete "a" (second occurrence);
line 59, delete "per se".

Col. 4, line 23, after "surface" insert --which--.

Col. 5, line 18, delete "be".

Col. 7, line 10, change "lower" to --lowered--;
line 41, change "is actually" to --actually--.

Col. 8, line 38, change "an one end" to --one end--.

Col. 9, line 45, change "FZ" to --F1--;
line 46, change "Ls" to --is--.

Col. 10, line 15, change "printer p" to --printer P--;
line 19, change "F2 = "0"." to --(F2 = "0").--.

Signed and Sealed this

Fourteenth Day of November, 1995

*Attest:*

Bruce Lehman

BRUCE LEHMAN

*Attesting Officer*

*Commissioner of Patents and Trademarks*